US010204572B2

(12) United States Patent
Lee et al.

(10) Patent No.: US 10,204,572 B2
(45) Date of Patent: Feb. 12, 2019

(54) DISPLAY APPARATUS OF MULTI-COLOR LIGHT SOURCES AND DRIVING METHOD THEREOF

(71) Applicant: AU Optronics Corp., Hsin-Chu (TW)

(72) Inventors: Seok-Lyul Lee, Hsin-Chu (TW); Yu-Chang Wen, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 0 days.

(21) Appl. No.: 14/994,192

(22) Filed: Jan. 13, 2016

(65) Prior Publication Data

US 2016/0300538 A1 Oct. 13, 2016

(30) Foreign Application Priority Data

Apr. 8, 2015 (TW) ..... 104111341 A

(51) Int. Cl.
*G09G 3/36* (2006.01)
*G09G 3/20* (2006.01)
*G09G 3/34* (2006.01)

(52) U.S. Cl.
CPC ..... *G09G 3/3607* (2013.01); *G09G 3/2025* (2013.01); *G09G 3/3413* (2013.01); *G09G 2300/0452* (2013.01); *G09G 2310/0235* (2013.01); *G09G 2310/0237* (2013.01); *G09G 2320/0242* (2013.01)

(58) Field of Classification Search
CPC .. G09G 3/2022; G09G 3/3413; G09G 3/2025; G09G 3/3607
USPC ..... 345/102
See application file for complete search history.

(56) References Cited

U.S. PATENT DOCUMENTS 7,580,023 B2 8/2009 Pugh et al.
8,558,781 B2 10/2013 Wu et al.
2002/0057253 A1* 5/2002 Lim ..... G09G 3/3611 345/102
2002/0060662 A1* 5/2002 Hong ..... G09G 3/3413 345/102

(Continued)

FOREIGN PATENT DOCUMENTS

CN 101963721 A 2/2011
CN 202855738 U 4/2013

(Continued)

OTHER PUBLICATIONS

Office Action issued in corresponding China patent application dated Oct. 10, 2016.

*Primary Examiner* — Adam J Snyder
(74) *Attorney, Agent, or Firm* — McClure, Qualey & Rodack, LLP

(57) ABSTRACT

A display apparatus including a plurality of pixels and a multi-color light source backlight module, and a driving method thereof are disclosed. Each pixel includes a first color sub-pixel, a second color sub-pixel, a third color sub-pixel, and a white sub-pixel. The backlight module includes a first color light source, a second color light source, and a third color light source. In a first sub-frame period, the first color light source and the second color light source are lightening; in a second sub-frame period, the second color light source and the third color light source are lightening; and in a third sub-frame period, the first color light source and the third color light source are lightening.

6 Claims, 8 Drawing Sheets

(56) References Cited

U.S. PATENT DOCUMENTS

2007/0182682 A1* 8/2007 Hong ..... G09G 3/3413 345/88
2009/0051631 A1* 2/2009 Okumura ..... G09G 3/3413 345/84
2009/0115803 A1* 5/2009 Langendijk ..... G09G 3/3413 345/102
2009/0135129 A1* 5/2009 Roth ..... G09G 3/3413 345/102
2010/0020109 A1* 1/2010 Belik ..... G09G 3/3413 345/690
2010/0039587 A1* 2/2010 Li ..... G09G 3/3406 349/68
2010/0188322 A1* 7/2010 Furukawa ..... G09G 3/3413 345/83
2012/0194578 A1* 8/2012 Znamenskiy ..... G09G 3/3413 345/694
2012/0287143 A1* 11/2012 Brown Elliott ..... G09G 3/3413 345/589
2012/0320103 A1* 12/2012 Jesme ..... G09G 3/3413 345/690
2013/0113847 A1* 5/2013 Mori ..... G09G 3/3413 345/87
2013/0293598 A1* 11/2013 Ishihara ..... G09G 3/3607 345/88
2015/0187287 A1* 7/2015 Kim ..... G09G 3/3413 345/691

FOREIGN PATENT DOCUMENTS

EP 2337014 6/2011
TW I444977 4/2009
TW I413078 11/2010
WO 2009040758 A2 4/2009

* cited by examiner

DISPLAY APPARATUS OF MULTI-COLOR LIGHT SOURCES AND DRIVING METHOD THEREOF

CROSS-REFERENCE TO RELATED APPLICATIONS

This non-provisional application claims priority under 35 U.S.C. § 119(a) on Patent Application No(s). 104111341 filed in Taiwan, R.O.C. on Apr. 8, 2015, the entire contents of which are hereby incorporated by reference.

TECHNICAL FIELD

The disclosure relates to a display apparatus, more particularly to a display apparatus having a wide color gamut.

BACKGROUND

A liquid crystal display panel usually includes sub-pixels for displaying different colors. For example, a RGB color system display device includes red, green and blue sub-pixels, and a CMY (cyan, magenta, yellow) color system display device includes cyan, magenta and yellow sub-pixels. In addition to such three-primary-color system display devices, multi-primary-color system display devices are also promoted. For example, a RGBW color system display device includes red, green, blue and white sub-pixels. In general, a RGB color system display device has a color gamut as shown in FIG. 1A.

To enlarge the color gamut, adjusting data signals is applied to the display panel. For example, transforming color gamut signals is employed to enlarge the color gamut. However, transforming color gamut signals causes the increase of computational complexity of a displayer and even causes the chromatic aberration that results in image distortion.

In addition, multi-primary-color system display panels usually include a color filter for filtering light except the light of a certain color corresponding to a single light source, but the thickness of the color filter causes the decrease of the transmittance of the display panel, resulting in the offset of frame images.

Accordingly, how to broaden the color gamut of a display apparatus and enhance the optical quality of the display apparatus is what the persons skilled in the art are striving toward.

SUMMARY

According to one or more embodiments, the disclosure provides a display apparatus. In one embodiment, the display apparatus includes a display panel and a backlight module. The display panel includes a plurality of pixels, and each of the pixels includes a first sub-pixel for displaying a first color, a second sub-pixel for displaying a second color, a third sub-pixel for displaying a third color, and a white sub-pixel. The first color, the second color, and the third color are different colors. The backlight module includes a plurality of light sources including a first color light source, a second color light source, and a third color light source. During a first sub-frame period, the first color light source and the second color light source are enabled, the third color light source is disabled, and blending light of the first color and the second color passes through the white sub-pixel. During a second sub-frame period, the second color light source and the third color light source are enabled, the third color light source is disabled, and blending light of the second color and the third color passes through the white sub-pixel. During a third sub-frame period, the first color light source and the third color light source are enabled, the second color light source is disabled, and blending light of the first color and the third color passes through the white sub-pixel. The first sub-frame period, the second sub-frame period, and the third sub-frame period do not overlap with each other.

According to one or more embodiments, the disclosure provides a driving method applied to a display apparatus which includes a first color sub-pixel, a second color sub-pixel, a third color sub-pixel, a white sub-pixel, a first color light source, a second color light source, and a third color light source. In one embodiment, the driving method includes the following steps. During a first sub-frame period, enable the first color light source and the second color light source and disable the third color light source so that blending light of a first color and a second color passes through the white sub-pixel, light of the first color passes through the first color sub-pixel, and light of the second color passes through the second color sub-pixel. During a second sub-frame period, enable the second color light source and the third color light source and disable the third color light source such that blending light of the second color and the third color passes through the white sub-pixel, the light of the second color passes through the second color sub-pixel, and the light of the third color passes through the third color sub-pixel. During a third sub-frame period, enable the first color light source and the third color light source and disable the second color light source so that blending light of the first color and the third color passes through the white sub-pixel, the light of the first color passes through the first color sub-pixel, and the light of the third color passes through the third color sub-pixel. The first sub-frame period, the second sub-frame period, and the third sub-frame period do not overlap with each other.

BRIEF DESCRIPTION OF THE DRAWINGS

The present invention will become more fully understood from the detailed description given herein below and the accompanying drawings which are given by way of illustration only and thus are not limitative of the present invention and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 3:
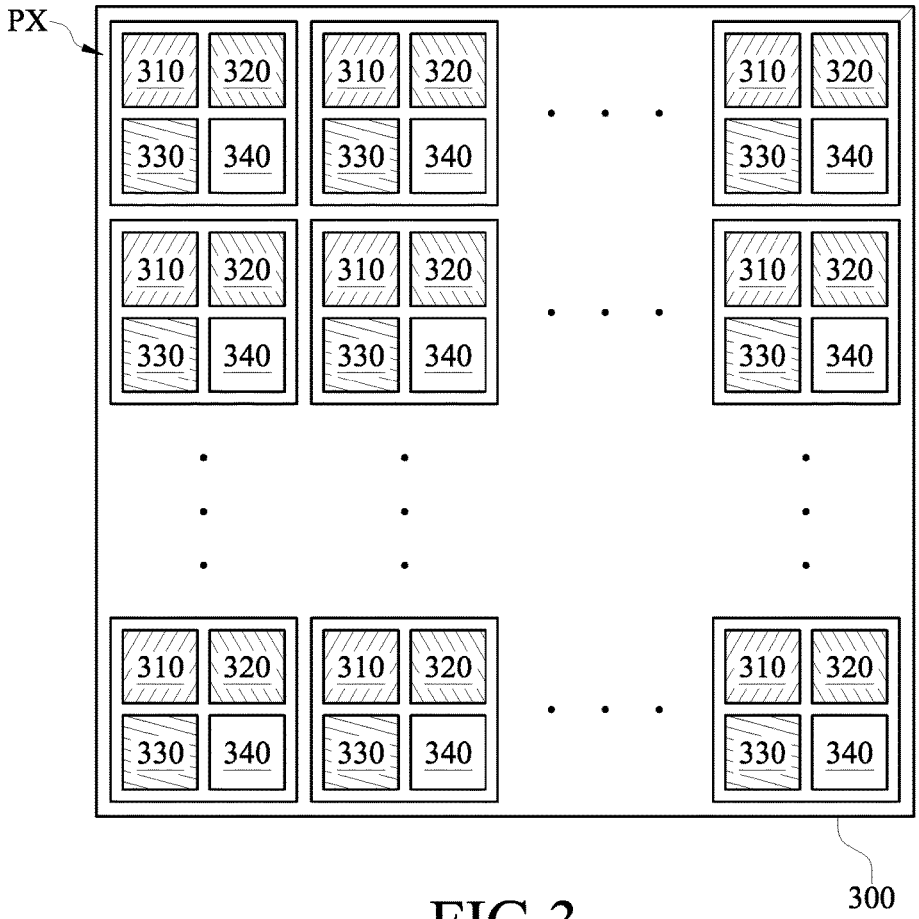
FIG. 3 is a schematic view of a display panel according to an embodiment of the disclosure.

Please refer to FIG. 3, which is a schematic view of a display panel 300 according to an embodiment of the disclosure. The display panel 300 includes a plurality of pixels PX, and each of the pixels PX includes a sub-pixel 310, a sub-pixel 320, a sub-pixel 330, and a sub-pixel 340. The sub-pixel 310 (referred to as first color sub-pixel) displays a first color, the sub-pixel 320 (referred to as second color sub-pixel) displays a second color, the sub-pixel 330 (referred to as third color sub-pixel) displays a third color, and the sub-pixel 340 is a white sub-pixel for displaying an additive color formed by mixing all light. In this embodiment, the sub-pixel 310, the sub-pixel 320, and the sub-pixel 330 are, for example but not limited to, red, green and blue sub-pixels respectively. In another embodiment, the sub-pixel 310, the sub-pixel 320, and the sub-pixel 330 are, for example but not limited to, cyan, magenta and yellow sub-pixels respectively. The sub-pixels of the pixel PX have a variety of rendering types. In one embodiment, every neighboring two of the sub-pixels respectively display a different color. In another embodiment, the sub-pixels in the pixel PX are arranged under a vertical stripe type or horizontal stripe type. The sub-pixels can have lots of rendering types.

Figure 4A:
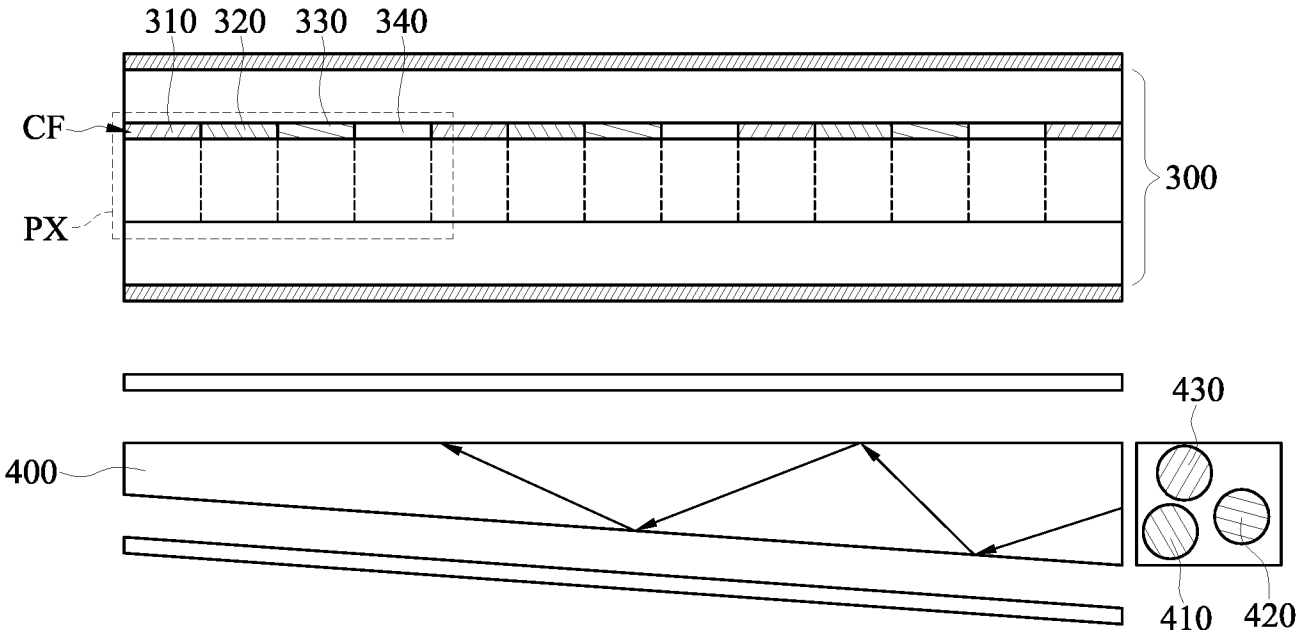
FIG. 4A is a schematic view of a backlight module in the display apparatus according to an embodiment of the disclosure.

Please refer to FIG. 4A, which is a schematic view of a backlight module 400 in the display apparatus according to an embodiment of the disclosure. The backlight module 400 includes a light source 410 (referred to as first color light source) for emitting first color light, a light source 420 (referred to as second color light source) for emitting second color light, and a light source 430 (referred to as third color light source) for emitting third color light. The colors of the first, second and third color light respectively correspond to the first, second and third colors displayed by the sub-pixels 310, 320 and 330 in the display panel 300.

For example, the sub-pixel 310 is a red sub-pixel that includes a red color filter layer for allowing red light to pass through it, the sub-pixel 320 is a green sub-pixel that includes a green color filter layer for allowing green light to pass through it, the sub-pixel 330 is a blue sub-pixel that includes a blue color filter layer for allowing blue light to pass through it, and the sub-pixel 340 is a white sub-pixel with high transmission rate for allowing light to pass through it. The backlight module 400 herein includes a red light source, a green light source, and a blue light source. The colors of light that the color filter layers of the sub-pixels 310, 320 and 330 in the pixel PX do not filter out have to correspond to the colors of light emitted by the light sources in the backlight module 400. Therefore, the color filter layer of each sub-pixel filters out the light of one or more unexpected colors emitted by one or more unexpected light sources, but keeps the light of an expected primary color emitted by an expected light source, and the mixed light of the backlight module 400 passes through the sub-pixel 340.

Figure 7:
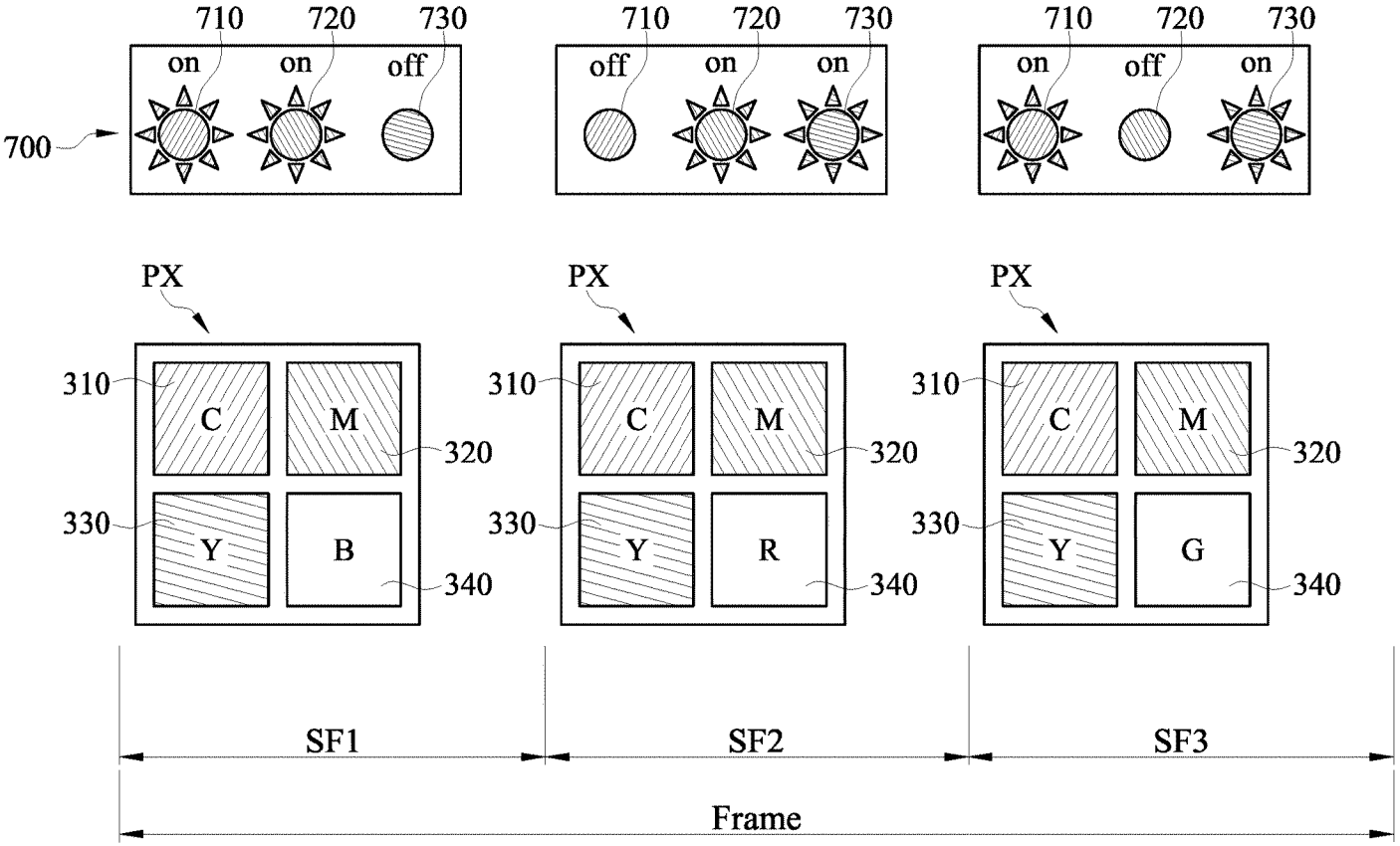
FIG. 7 is a schematic driving timing diagram of a display apparatus according to another embodiment of the disclosure.

Please refer to FIG. 7, which illustrates a backlight modules 700 and the foregoing sub-pixels 310-340. The sub-pixels 310, 320 and 330 respectively represent a cyan sub-pixel, a magenta sub-pixel, and a yellow sub-pixel. The cyan sub-pixel includes a cyan color filter layer for filtering out light except cyan light. The magenta sub-pixel includes a magenta color filter layer for filtering out light except magenta light. The yellow sub-pixel includes a yellow color filter layer for filtering out light except yellow light. The backlight module 700 includes a cyan light source 710, a magenta light source 720, and a yellow light source 730. According to the embodiment, the color of each light source in the backlight module needs to be the same as the color of the corresponding sub-pixel so that the corresponding sub-pixel displays the color the same as the color of the corresponding light source. Also, the pixel PX has to include a white sub-pixel which light of a certain color formed by additively mixing the light sources can pass through.

The detailed operation of the display apparatus is described as follows by referring to FIG. 4B, which is a schematic driving timing diagram of the backlight module in FIG. 4A according to an embodiment of the disclosure. A frame period of one frame image includes three sub-frame periods SF. A frame period is the time to display a complete frame image. Each of the sub-frame periods SF is the time to sequentially enable all scan lines of a displayer.

During the first sub-frame period SF1, the light source 410 and the light source 420 are enabled but the light source 430 is disabled. During the second sub-frame period SF2, the light source 420 and the light source 430 are enabled but the light source 410 is disabled. During the third sub-frame period SF3, the light source 410 and the light source 430 are enabled but the light source 420 is disabled. Human visual systems require a frame rate of at least 60 hertz (i.e. 1/60 second), so a refresh rate of a displayer is usually 60 hertz. To form a complete frame image by combining three sub-frames in the three sub-frame periods together, the refresh rate is, according to one embodiment, higher than or equal to 180 hertz during each sub-frame period. Therefore, the human visual system can sense complete frame images displayed under a frame rate of 60 hertz. The above refresh rate of sub-frames depends on the response rate of liquid crystals of the display panel, on the data transition rate, or on the user's requirements.

Figure 5:
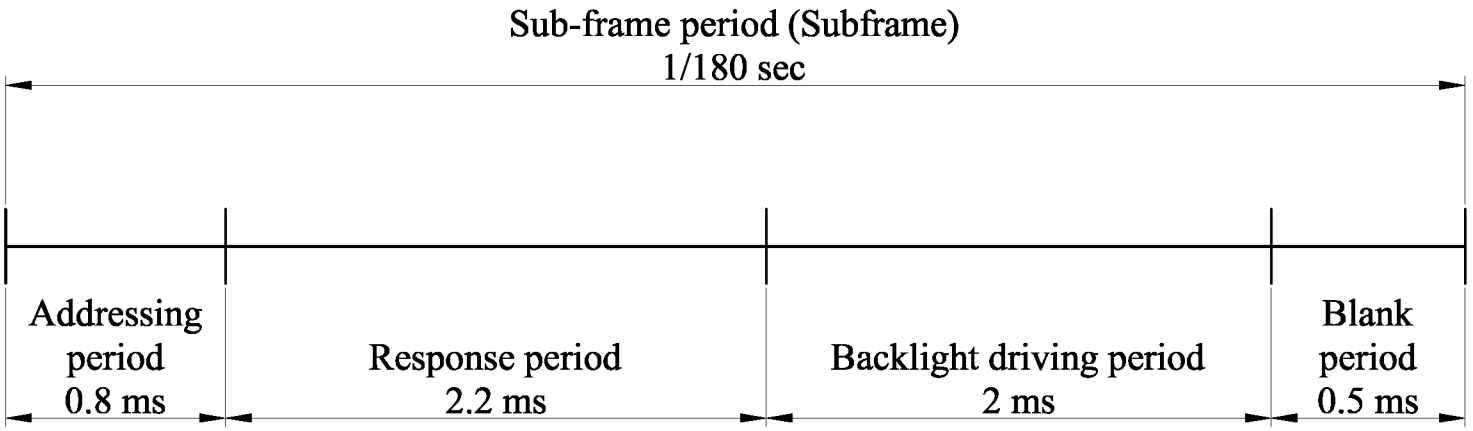
FIG. 5 is a schematic diagram of a sub-frame period according to an embodiment of the disclosure.

Please refer to FIG. 5, which is a schematic diagram of a sub-frame period according to an embodiment of the disclosure. Each sub-frame period SF includes an address period, a response period, a backlight driving period, and a blank period. The address period is the time to writing a data signal into a pixel PX. In this embodiment, the sub-frame period is 1/180 second (about 5.56 millisecond (ms)) so transistors with high mobility electron-hole pairs in the display panel needs about 0.8 ms or less than 0.8 ms to finish addressing. These transistors include, for example, a-si TFTs, LTPS TFTs, and Oxide TFTs. The response period can be related to the response rate of liquid crystals and indicates the time that liquid crystals are being charged to a determined data voltage. For example, these liquid crystals include fast nematic liquid crystals, smectic liquid crystals, and cholesteric liquid crystals, which have a high response rate to carry out the disclosure. For example, the response period is equal to or shorter than 2.2 ms in general. However, it can take about 4 ms or less than 4 ms from addressing to charging liquid crystals. The backlight driving period is the time for enabling one or more light sources by the backlight module. After liquid crystals are charged, one or more light sources in the backlight module are enabled to make each sub-pixel display a correlative color during the correlative driving time. The turned-on time of the light source is, for example but not limited to, longer than or equal to 2 ms. The blank period is the time to prevent a sub-frame image during a sub-frame from being interfered by a previous sub-frame during a previous sub-frame period, and is removable or adjustable according to actual application requirements.

The detailed operation of the display apparatus is described in the following embodiments.

Figure 2A:
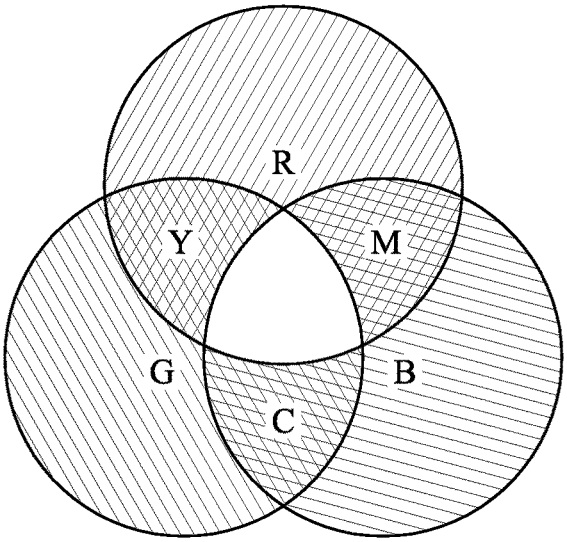
FIG. 2A is a schematic diagram of an additive color mixing of red, green, blue light sources.
Figure 4B:
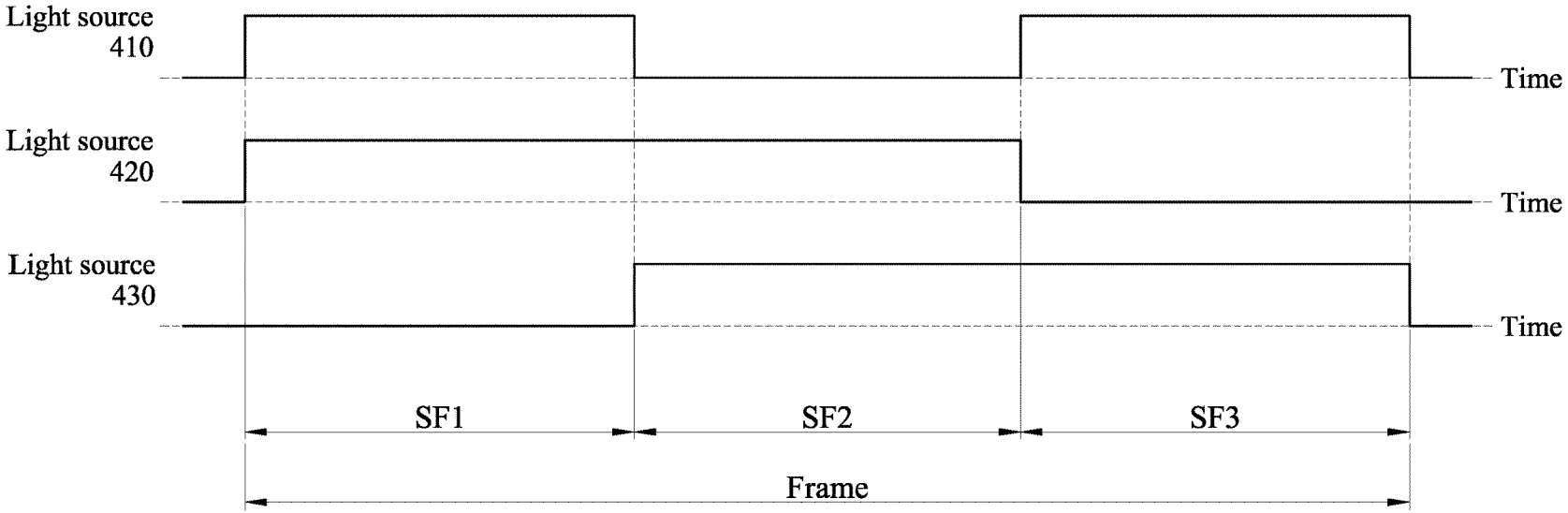
FIG. 4B is a schematic driving timing diagram of the backlight module in FIG. 4A according to an embodiment of the disclosure.
Figure 6:
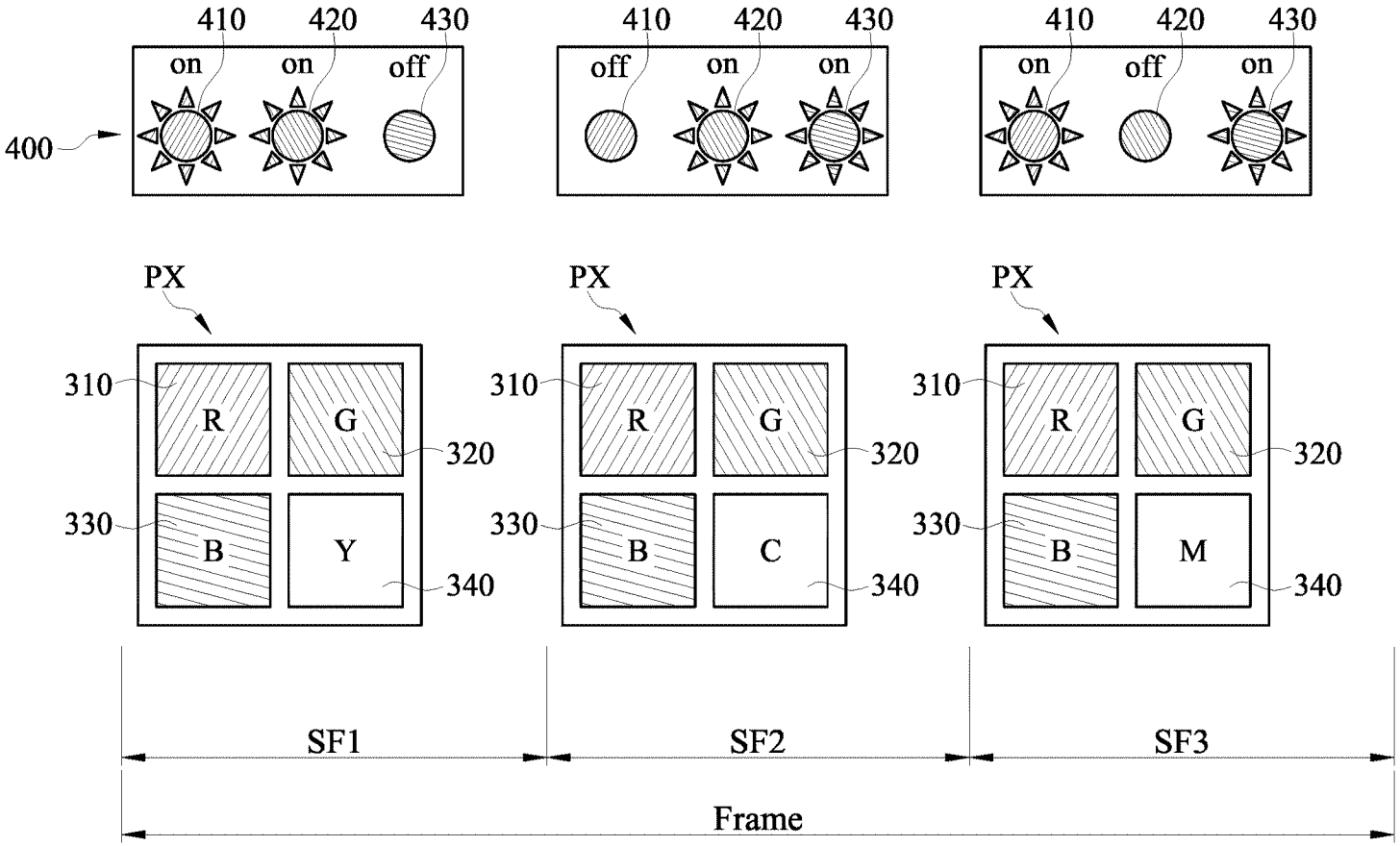
FIG. 6 is a schematic driving timing diagram of a display apparatus according to an embodiment of the disclosure.

Please refer to FIG. 2A, which illustrates an additive color mixing of red, green and blue light, FIG. 4B, which illustrates the driving timing of the backlight module, FIG. 5, which illustrates a sub-frame period, and FIG. 6, which illustrates the driving timing of a display apparatus. During the first sub-frame period SF1, the backlight module enables the red light source 410 and the green light source 420 but disables the blue light source 430. Herein, red light passes through the red sub-pixel, green light passes through the green sub-pixel, and no light passes through the blue sub-pixel because of the lack of blue light. The red light and the green light are mixed and come into yellow light, so the yellow light then passes through the white sub-pixel 340 during the first sub-frame period SF1.

During the second sub-frame period SF2, the backlight module enables the green light source 420 and the blue light source 430 but disables the red light source 410. Herein, green light passes through the green sub-pixel, blue light passes through the blue sub-pixel, and no light passes through the red sub-pixel because of the lack of red light. Then, the green light and the blue light are mixed and come into cyan light, so the cyan light passes through the white sub-pixel 340 during the second sub-frame period SF2.

During the third sub-frame period SF3, the backlight module enables the red light source 410 and the blue light source 430 but disables the green light source 420. Red light passes through the red sub-pixel. Blue light passes through the blue sub-pixel. And no light passes through the green sub-pixel because of the lack of green light. Then, the red light and the blue light are mixed and come into magenta light, so the magenta light passes through the white sub-pixel 340 during the third sub-frame period SF3.

Figure 1A:
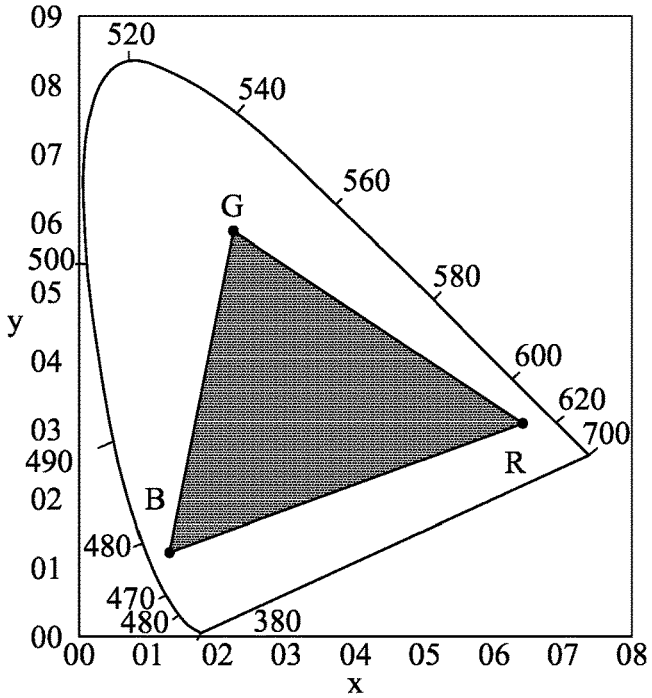
FIG. 1A is a schematic diagram of a NTSC color gamut of a three-primary-color (red-green-blue, RGB) system display.
Figure 1B:
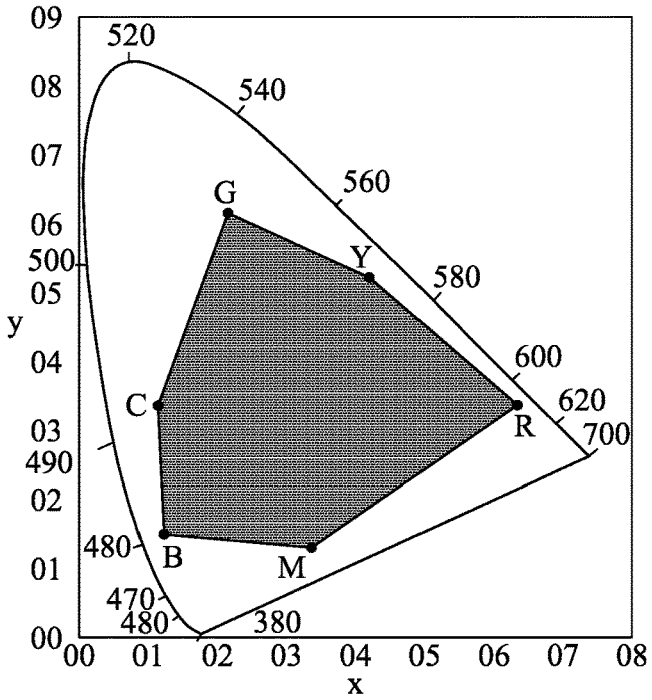
FIG. 1B is a schematic diagram of a NTSC color gamut of a six-primary-color (red-green-blue-cyan-magenta-yellow, RGBCMY) system display.

In this way, the pixel PX displays red, green and yellow (RGY) during the first sub-frame period SF1, displays green, blue and cyan (GBC) during the second sub-frame period SF2, and displays red, blue and magenta (RBM) during the third sub-frame period SF3 in order to display a complete frame image during a frame period Frame. Also, a color gamut shown in FIG. 1B can be obtained. By involving time-divisionally driving the light sources and the RGBW pixel arrangement, the display devices can display 6 primary colors in a frame which have a color gamut broader than the three-primary-color system display device. Thus, the display device can display a higher saturation and distortionless image.

Figure 2B:
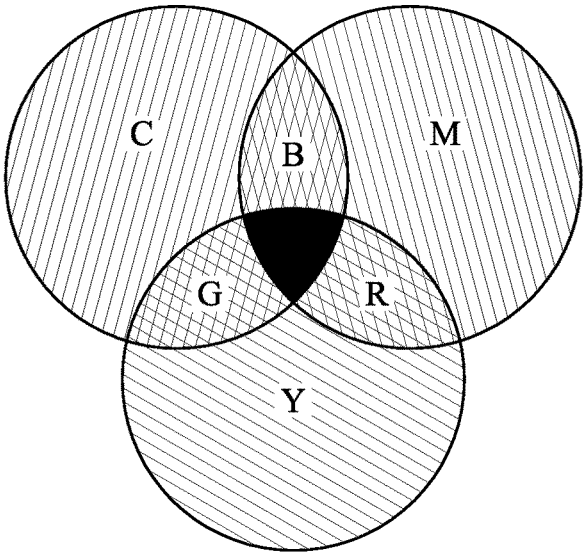
FIG. 2B is a schematic diagram of an additive color mixing of cyan, magenta and yellow light sources.

Another embodiment of the detailed operation of the display apparatus is illustrated by referring to FIG. 2B, which illustrates an additive color mixing of cyan, magenta and yellow light, FIG. 4B, and FIG. 7, which illustrates the driving timing of the display apparatus. During the first sub-frame period SF1, the backlight module enables the cyan light source 710 and the magenta light source 720 but disables the yellow light source 730. Herein, cyan light passes through the cyan sub-pixel, magenta light passes through the magenta sub-pixel, and because of the lack of yellow light, no light passes through the yellow sub-pixel. Therefore, the cyan light and the magenta light are mixed and come into blue light, and then the blue light passes through the white sub-pixel 340 during the first sub-frame period SF1.

During the second sub-frame period SF2, the backlight module enables the magenta light source 720 and the yellow light source 730 but disables the cyan light source 710. Herein, magenta light passes through the magenta sub-pixel, yellow light passes through the yellow sub-pixel, and no light passes through the cyan sub-pixel because of the lack of cyan light. Then, the magenta light and the yellow light are mixed and come into red light. Therefore, the red light passes through the white sub-pixel 340 during the second sub-frame period SF2.

During the third sub-frame period SF3, the backlight module enables the cyan light source 710 and the yellow light source 730 but disables the magenta light source 720. Herein, cyan light passes through the cyan sub-pixel, yellow light passes through the yellow sub-pixel, and because of the lack of magenta light, no light passes through the magenta sub-pixel. The cyan light and the yellow light are mixed and come into green light, so the green light passes through the white sub-pixel 340 during the third sub-frame period SF3.

The pixel PX displays cyan, magenta and blue (CMB) during the first sub-frame period SF1, displays magenta, yellow and red (MYR) during the second sub-frame period SF2, and displays cyan, yellow and green (CYG) during the third sub-frame period SF3 in order to display a complete frame image during a frame period Frame. By time-divisionally driving the light sources and the RGBW sub-pixel arrangement, the display panel can display 6 primary color in a frame which has a color gamut broader than the three-primary-color system display device. Thus, the display device can display a higher saturation and distortionless image.

In the above embodiments, the disclosure provides a display apparatus and a driving method thereof. The display apparatus time-divisionally drives a display panel including a color filter layer, sub-pixels and white sub-pixels by a backlight module including multiple primary color light sources. Light emitted by the light sources can pass through the color filter layer and the corresponding sub-pixels, and additive light formed by mixing the light emitted by the light sources can pass through the white sub-pixel. Therefore, the display apparatus may display a frame image having a broader color gamut and a correct grey value without the increase of computational complexity.

What is claimed is:

1. A display apparatus, comprising:

a display panel comprising a plurality of pixels, each of the plurality of pixels comprising a first sub-pixel for displaying a first color, a second sub-pixel for displaying a second color, a third sub-pixel for displaying a third color, and a white sub-pixel, and the first, second and third colors being different from each other;

a backlight module comprising a plurality of light sources that comprises a first color light source, a second color light source, and a third color light source, wherein during a first sub-frame period, the first color light source and the second color light source are enabled, the third color light source is disabled, and blending light of the first color and the second color passes through the white sub-pixel;

during a second sub-frame period, the second color light source and the third color light source are enabled, the first color light source is disabled, and blending light of the second color and the third color passes through the white sub-pixel;

during a third sub-frame period, the first color light source and the third color light source are enabled, the second color light source is disabled, blending light of the first color and the third color passes through the white sub-pixel; and the first sub-frame period, the second sub-frame period, and the third sub-frame period do not overlap with each other;

wherein each of the plurality of pixels displays red, green and yellow (RGY) during the first sub-frame period, displays green, blue and cyan (GBC) during the second sub-frame period, and displays red, blue and magenta (RBM) during the third sub-frame period in order to display a complete frame image during a frame period, the display apparatus has a RYGCBM color gamut.

2. A driving method applied to a display apparatus that comprises a first color sub-pixel, a second color sub-pixel, a third color sub-pixel, a white sub-pixel, a first color light source, a second color light source, and a third color light source, and the driving method comprising:

during a first sub-frame period, enabling the first color light source and the second color light source and disabling the third color light source so that blending light of a first color and a second color passes through the white sub-pixel, light of the first color passes through the first color sub-pixel, and light of the second color passes through the second color sub-pixel;

during a second sub-frame period, enabling the second color light source and the third color light source and disabling the third color light source so that blending light of the second color and a third color passes through the white sub-pixel, the light of the second color passes through the second color sub-pixel, and light of the third color passes through the third color sub-pixel; and during a third sub-frame period, enabling the first color light source and the third color light source and disabling the second color light source so that blending light of the first color and the third color passes through the white sub-pixel, the light of the first color passes through the first color sub-pixel, and the light of the third color passes through the third color sub-pixel, wherein the first sub-frame period, the second sub-frame period, and the third sub-frame period do not overlap with each other;

wherein the display apparatus has a RYGCBM color gamut;

wherein each of the plurality of pixels displays red, green and yellow (RGY) during the first sub-frame period, displays green, blue and cyan (GBC) during the second sub-frame period, and displays red, blue and magenta (RBM) during the third sub-frame period in order to display a complete frame image during a frame period.

3. The driving method according to claim 2, wherein each of the sub-frame periods comprises:

an address period in which a data signal is sent to a data line;

a response period in which the data signal is written into one of the sub-pixels; and a backlight driving period in which the first color light source, the second color light source, and the third color light source are enabled.

4. The driving method according to claim 3, wherein each of the sub-frame periods further comprises a blank period following the backlight driving period.

5. The driving method according to claim 2, wherein each of the sub-frame periods is not shorter than 1/180 second.

6. A display apparatus, comprising:

a display panel comprising a plurality of pixels, each of the plurality of pixels comprising a first sub-pixel for displaying a first color, a second sub-pixel for displaying a second color, a third sub-pixel for displaying a third color, and a white sub-pixel, and the first, second and third colors being different from each other;

a backlight module comprising a plurality of light sources that comprises a first color light source, a second color light source, and a third color light source, wherein during a first sub-frame period, the first color light source and the second color light source are enabled, the third color light source is disabled, and blending light of the first color and the second color passes through the white sub-pixel;

during a second sub-frame period, the second color light source and the third color light source are enabled, the first color light source is disabled, and blending light of the second color and the third color passes through the white sub-pixel;

during a third sub-frame period, the first color light source and the third color light source are enabled, the second color light source is disabled, blending light of the first color and the third color passes through the white sub-pixel; and the first sub-frame period, the second sub-frame period, and the third sub-frame period do not overlap with each other;

wherein the first color is red, the second color is green, and the third color is blue, and each of the plurality of pixels displays red, green and yellow (RGY) during the first sub-frame period, displays green, blue and cyan (GBC) during the second sub-frame period, and displays red, blue and magenta (RBM) during the third sub-frame period in order to display a complete frame image during a frame period, the display apparatus has a RYGCBM color gamut.

* * * * *